US008092265B2

(12) United States Patent
Gongwer

(10) Patent No.: US 8,092,265 B2
(45) Date of Patent: Jan. 10, 2012

(54) JET PROPULSION DEVICE

(76) Inventor: Calvin A Gongwer, Glendora, CA (US)

( * ) Notice: Subject to any disclaimer, the term of this patent is extended or adjusted under 35 U.S.C. 154(b) by 127 days.

(21) Appl. No.: 12/473,201

(22) Filed: May 27, 2009

(65) Prior Publication Data

US 2010/0330854 A1 Dec. 30, 2010

(51) Int. Cl.
*B63H 11/103* (2006.01)

(52) U.S. Cl. ..... 440/44; 440/47

(58) Field of Classification Search ..... 440/44, 440/45, 47; 60/221
See application file for complete search history.

(56) References Cited

U.S. PATENT DOCUMENTS 3,079,753 A 3/1963 Gongwer
5,421,153 A * 6/1995 Schleicher et al. ..... 60/221

OTHER PUBLICATIONS

Birkhoff G. and Zarantonello E.H., "Jets, Wakes, and Cavities," Applied Mathematics and Mechanics, vol. II, Academic Press Inc, New York, 1957.

* cited by examiner

*Primary Examiner* — Stephen Avila
(74) *Attorney, Agent, or Firm* — Alston & Bird LLP

(57) ABSTRACT

A jet propulsion device and method for controlling movement of the jet propulsion device, where liquid inlets are positioned at a distance from the surface of the device. Preferably, the inlets are positioned in the stabilizing fins of the device. When the device reaches a certain speed, a Riabouchinsky cavity forms around the device, and the radius of the Riabouchinsky cavity is substantially equal to the distance between the inlets and the longitudinal axis of the device.

20 Claims, 3 Drawing Sheets

JET PROPULSION DEVICE

FIELD OF THE INVENTION

The field of the present invention pertains generally to jet propulsion devices, including underwater jet propulsion devices.

BACKGROUND

Jet propulsion devices are known in the art of underwater vessels. For example, U.S. Pat. No. 3,079,753 describes a jet propulsion device where a wholly condensable jet of steam is produced by vaporizing seawater, fed by ram pressure into a reaction chamber. In the device of '753 patent water enters the device through water inlets in the front portion of the device's housing adjacent to the nose of the housing. The water evaporates in a reaction chamber of the '753 device, and vapor passes through exhaust nozzles and propels the device. However, when the jet propulsion device of '753 patent was launched, at higher speeds the device generated a vapor-filled Riabouchinsky cavity around its housing. Such cavities are described in literature as Riabouchinsky cavities. See, for example, Birkhoff, *Jets Wakes and Cavities*. Inside a Riabouchinsky cavity is a low-pressure zone, filled with water vapor. When the speed of the jet propulsion device started to grow, the radius of the Riabouchinsky cavity also started to increase. In a low pressure zone of the Riabouchinsky cavity the drag of the jet propulsion device decreased. As a result of the decreased drag and the increase of water intake due to increase of ram pressure on the water entering the device, the speed of the device kept increasing and the Riabouchinsky cavity kept growing. At a critical speed the Riabouchinsky cavity grew large enough to reduce the immersion of the tail fins of the device enough to cause the device to yaw violently and cease to operate. In other words, when the device of '753 was tested, it would uncontrollably accelerate until the low-pressure Riabouchinsky cavity around its body grew big enough, so the fins were no longer immersed in water and were unable to support a stable forward movement, causing the device to deviate erratically from the course and then stop completely. To solve these problems, a device capable of stable jet propulsion movement at high speeds is needed.

SUMMARY OF THE INVENTION

The inventions presented herein provide a jet propulsion device and method for controlling movement of the jet propulsion device. In one of the embodiments the surrounding liquid enters the device under ram pressure through inlets and travels to a reaction chamber where it is vaporized. Preferably, the vapor-liquid mixture exits the device through nozzle-shaped exhaust openings, propelling the device. The liquid inlets are positioned at a distance from the surface of the device. Preferably, the inlets are positioned in the stabilizing fins of the device. When the device reaches a certain speed, a Riabouchinsky cavity forms around the device. The jet propulsion devise is configured so that the radius of the Riabouchinsky cavity is substantially equal to the distance between the inlets and the longitudinal axis of the device. The walls of the Riabouchinsky cavity serve as a condenser surface for the vapor, exiting the nozzles. In the preferred embodiment the surrounding liquid is water or seawater.

DETAILED DESCRIPTION OF THE DRAWINGS

Figure 1:
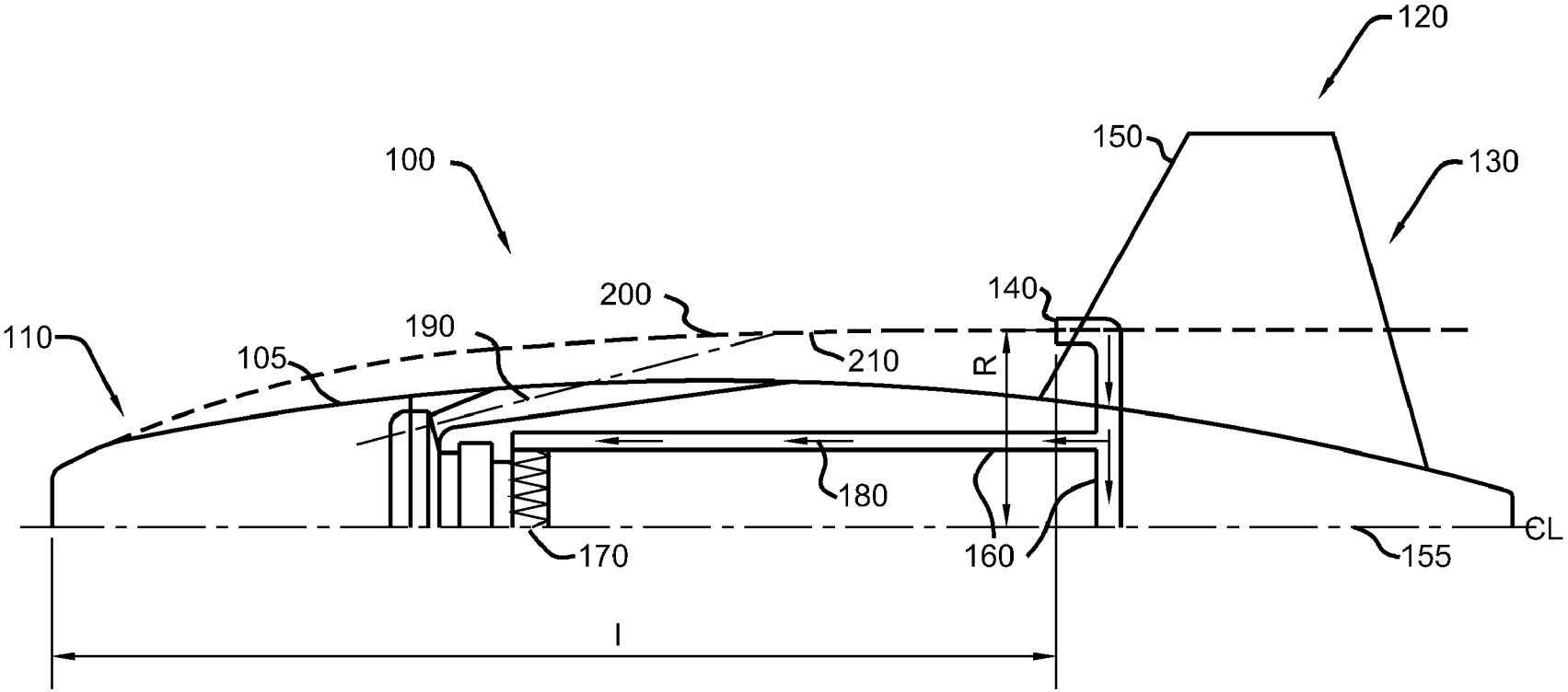
FIG. 1 is a section view of a jet propulsion device.

A side view of a jet propulsion device 100 is depicted in FIG. 1. A housing 105 of the jet propulsion device has a nose 110 and a tail 120. Preferably, a number of fins 130 are located at the tail end of the device. In one embodiment of the invention, there are three fins spaced equally around the tail portion of the housing. However, in other embodiments, there maybe any other number of fins used, spaced in different configurations. In one of the embodiments liquid inlets 140 are positioned in the leading edges 150 of the fins 130. On FIG. 1 the distance from the inlet 140 to the longitudinal axis 155 of the device 10 is marked R and the distance from the nose 110 of the device 100 to the inlet 140 is marked l.

When the device 100 is traveling under a liquid's surface, the movement of the device creates a ram pressure. In a preferred embodiment, the ram pressure forces liquid, surrounding the device 100, to enter the device 100 through inlets 140. The ram pressure increases when the speed of the device 100 increases. As a result, the amount of liquid entering the device 100 increases when the speed of the device increases. In a preferred embodiment the surrounding liquid is water or seawater.

In a preferred embodiment, after liquid 180 enters the device 100 through the inlets 140, it travels through liquid conduits 160 to a reaction chamber 170. Different configurations of the reaction chamber can be utilized. In one of the embodiments, the device 100 is equipped with a reaction chamber, described in U.S. Pat. No. 3,079,753 to C. A. Gongwer. Other configurations of reaction chambers can be used with the present invention.

Preferably, in the reaction chamber 170 at least a portion of the liquid 180 is vaporized. In the preferred embodiment, the reaction chamber 170 produces the liquid/vapor mixture of about 50% vapor by weight and 50% liquid droplets. After at least a portion of the liquid 180 is evaporated at the reaction chamber 170, the vapor and liquid mixture travels further through the liquid conduits 160 to exhaust openings 190. Preferably, the exhaust openings 190 are positioned in proximity to the nose portion of the device. In one of the embodiments the exhaust openings 190 are arranged in a circle surrounding the housing 105 of the device 100. Preferably, the exhaust openings 190 are directed towards the tail 120 of the device 100 to propel the device 100 in the direction of the nose 110.

In one of the embodiments, the exhaust openings 190 have nozzle shape. Preferably, the exhaust openings 190 have a shape of a convergent-divergent nozzle or a De Laval nozzle. However, other exhaust opening shapes can be used with the present invention.

When the vapor and liquid mixture passes through the exhaust openings 190, the pressure drops across the exhaust opening, which causes the vapor and liquid particles to accelerate and, as a result, to propel the device 100 in the direction opposite to the direction of the exhaust openings 190. The amount of thrust, created by the exiting liquid/vapor mixture depends on the amount of the mixture exiting the device 100. Accordingly, when the amount of liquid entering the device 100 increases, the amount of liquid/vapor mixture exiting the device 100 through the exhaust openings 190 increases correspondingly, and the device 100 accelerates.

Figure 2:
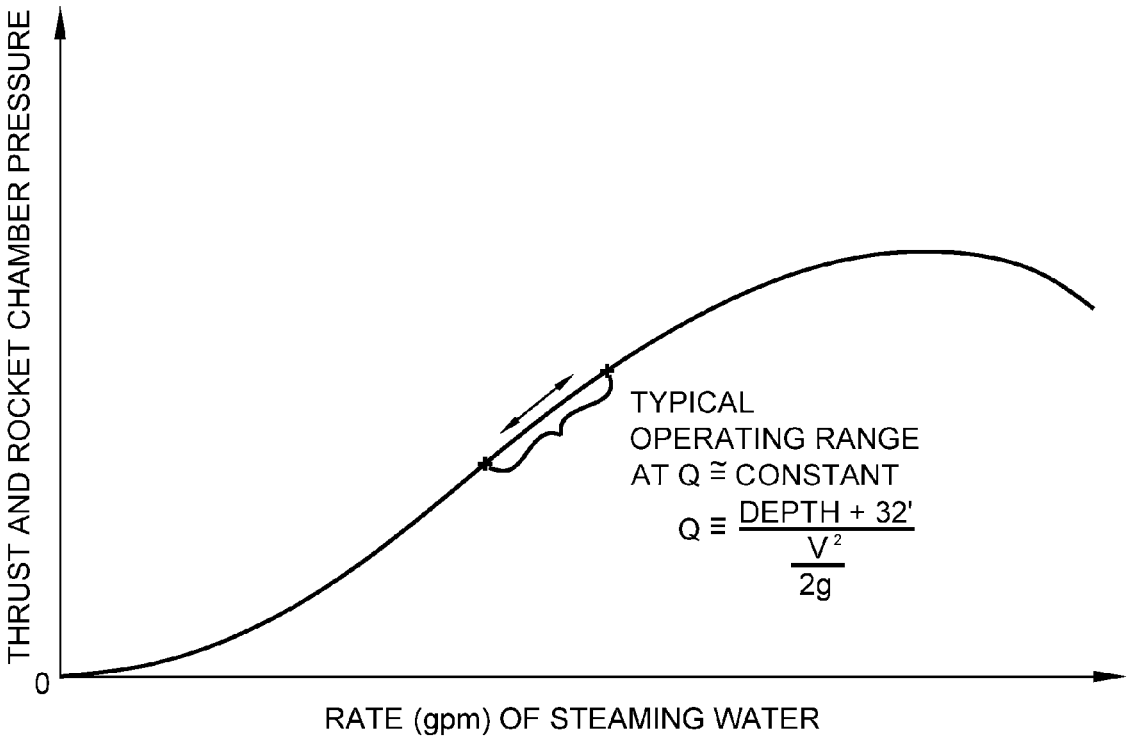
FIG. 2 shows a graph of thrust and rocket chamber pressure vs. rate of steaming water.

FIG. 2 shows a graph of thrust and reaction chamber pressure vs. rate of seaming water, entering the jet propulsion device. As shown, when the amount of water entering the reaction chamber 170 increases, the thrust of the jet propulsion device 100 increases accordingly.

The movement of the device 100 through the liquid creates a low-pressure vapor-filled Riabouchinsky cavity 200 around the device 100, also called a Riabouchinsky cavity. The Riabouchinsky cavity wall 210 acts as a condensing surface for the vapor expelled by the exhaust openings 190, preserving the trust as depth increases. The surface of the Riabouchinsky cavity wall is large enough to condense all vapor output of the exhaust openings. In some embodiments, the vapor exits the exhaust openings 190 at the speed of about 2000 ft/sec. As a result, the condensate disturbs and extends the Riabouchinsky cavity surface as it imparts momentum of the device 100.

Speed law for Riabouchinsky cavities can be described by equation (1):

$$\upsilon=\sqrt{(D\cdot 2g/Q)} \quad (1)$$

where $\upsilon$—speed of the device;

D—depth of the device;

Q—cavitation number of the Riabouchinsky cavity, wherein Q is a constant calculated as follows:

$$Q=D/(\upsilon^2/2g) \quad (2)$$

Figure 3:
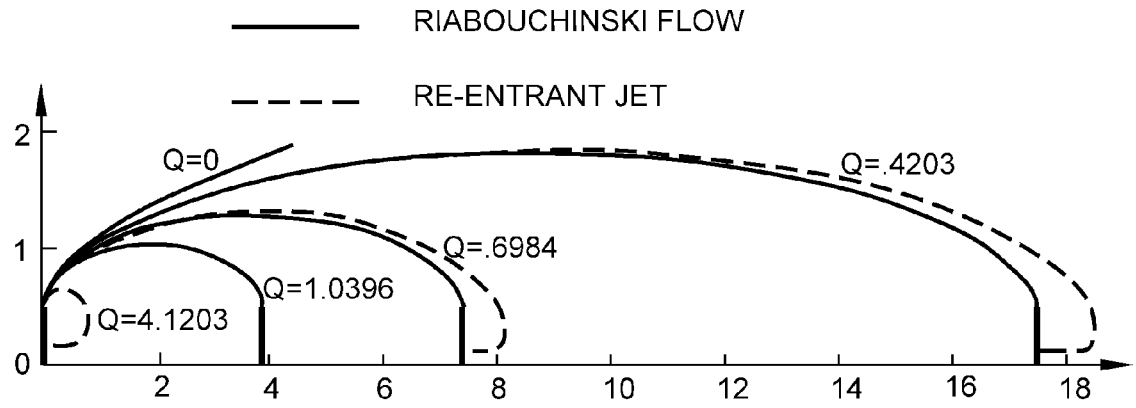
FIG. 3 shows a profile of Riabouchinsky cavities with different cavitation numbers.

FIG. 3 shows examples of Riabouchinsky cavity profiles with different cavitation numbers. Riabouchinsky cavities of higher radii have lower cavitation numbers.

Figure 4:
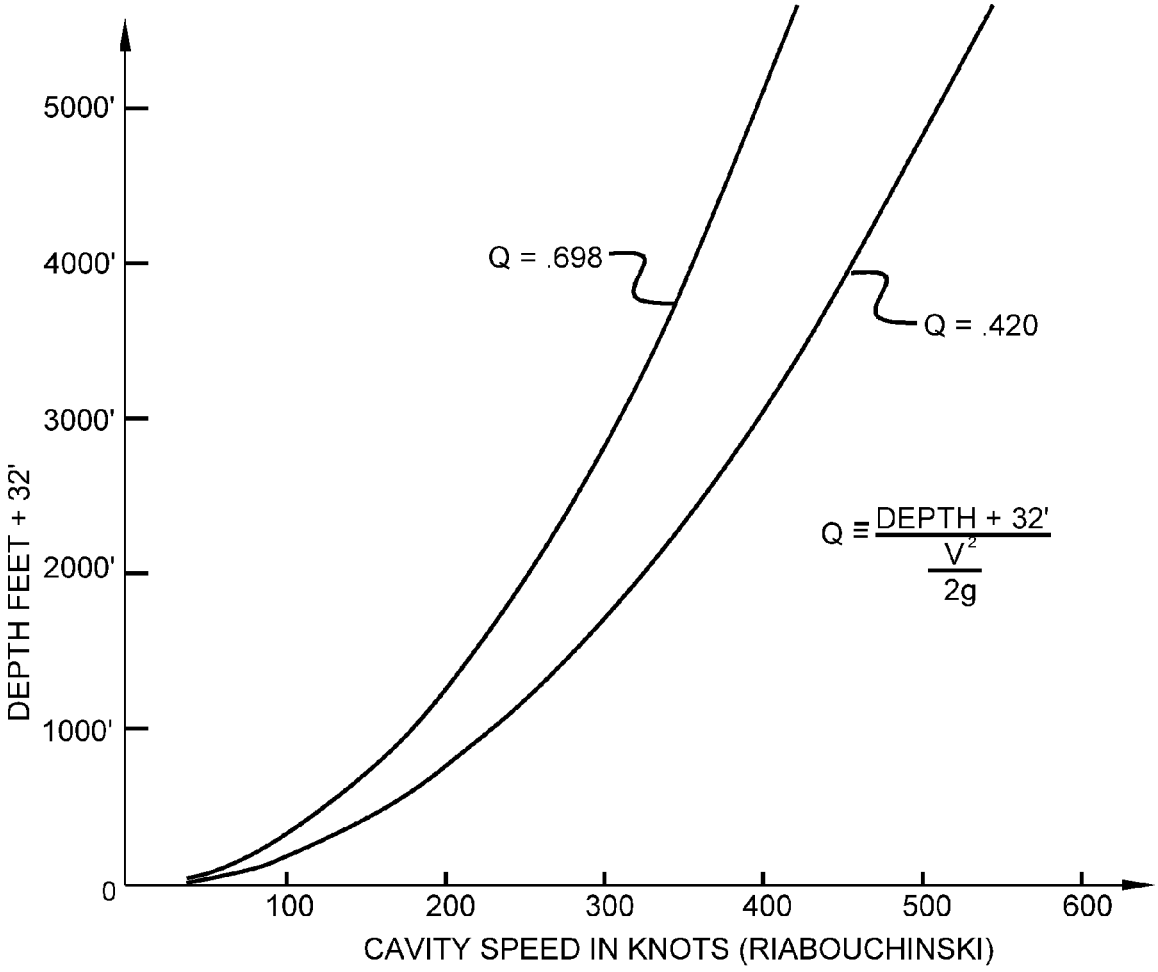
FIG. 4 shows a graph of depth of submersion of the jet propulsion device vs. cavity speed (jet propulsion device speed) in knots.

As shown above in formula (1), speed of the device 100 increases proportionally to the square root of the depth of the device 100. FIG. 4 shows graphs of depth of the device 100 vs. speed of the device. Examples of graphs with different cavitation numbers are show.

When the radius of the Riabouchinsky cavity 200 is less than R (where R is the distance from the inlets 140 to the longitudinal axis of the device), the Riabouchinsky cavity does not reach the inlets 140. As a result, the inlets 140 are immersed in liquid, surrounding the device 100, and the rate of the liquid entering the inlets 140 increases with the increase in the speed of the device 100, which causes the increase in the ram pressure on the housing 105 of the device 100. When the speed of the device 100 increases, the radius of the Riabouchinsky cavity 200 also increases. At some point the radius of the Riabouchinsky cavity 200 becomes equal to R. Since the inside of the Riabouchinsky cavity 200 is a low pressure area, when the inlets 140 become submerged in the Riabouchinsky cavity 200, the rate of liquid intake of the inlets 140 starts to decrease. The decrease in liquid intake causes the decrease in the amount of liquid 180 traveling to the reaction chamber 170, which, in turn, causes the decrease in the amount of liquid/vapor mixture created in the chamber 170 and passing through the exhaust nozzles 190. The decrease in the amount of liquid/vapor mixture exiting the device 100 results in slowing down of the device. When the device 100 slows down, the Riabouchinsky cavity 200 shrinks in diameter, exposing the inlets 140 to a free flow of liquid and causing the speed of the device 100 to increase.

The device 100 eventually settles at equilibrium where it runs substantially at a constant speed $\upsilon$ with the Riabouchinsky cavity of approximately fixed size. At equilibrium, the profile of the Riabouchinsky cavity 200, formed by the jet propulsion device 100 of the present invention, moving at a constant speed $\upsilon$, is such, that the Riabouchinsky cavity wall 210 hits the edge 150 of the fins 130 at the same height R where the inlets 140 are located, i.e. the wall of the Riabouchinsky cavity 200 centers on the inlets 140.

As a result, in accordance with formula (2), at a fixed depth the device 100 forms a Riabouchinsky cavity of the fixed cavitation number. Since the speed of the device is proportionate to the square route of depth of the device, the device 100 runs at a fixed speed, determined by the size of the Riabouchinsky cavity 200 and the depth of the device.

When the device 100 goes deeper, according to formula (2) the cavitation number increases and the Riabouchinsky cavity 200 shrinks, immersing the inlets 140 into surrounding liquid. When the inlet is immersed in liquid, the flow of liquid through the inlets 140 also increases and the speed of the device 100 rises. The increase in the speed of the device 100 causes the Riabouchinsky cavity 200 to expand back above the inlets 140. Eventually the Riabouchinsky cavity centers again at radius R at the previous cavitation number of the Riabouchinsky cavity and the new increased speed of the device 100. As a result, the diameter of the Riabouchinsky cavity 200 and its cavitation number remain constant, and the Riabouchinsky cavity wall continues being centered on the inlets 140 after the change of speed of the device 100 to compensate for the depth change.

Similarly, when the device 100 rises or decreases its depth, it results in the device 100 slowing down and finding it new equilibrium speed with the Riabouchinsky cavity 200 centered again on the inlets 140.

In a preferred embodiment the profile of the housing 105 of the device 100 generally corresponds to the profile of a Riabouchinsky cavity. In particular, it is preferred that the nose 110 and the tail 120 profiles are ogival to better correspond to the profile of the Riabouchinsky cavity 200. However, in some of the embodiments the tips of the nose 110 and/or the tail 120 are flat.

In one embodiment, the length of the device 100 is substantially the same or less than the length of the Riabouchinsky cavity 200. As a result the housing 105 is practically immersed in the Riabouchinsky cavity 200, except for the portions of the fins 130 above the inlets 140. This configuration decreases the surface of the housing 105 in contact with the surrounding liquid, which in turn decreases the amount of drag of the device 100.

Since at a constant speed $\upsilon$ the cavitation number of the Riabouchinsky cavity 200, forming around the device 200, remains the same and the walls of the Riabouchinsky cavity are centered on the inlets 140, the equilibrium speed $\upsilon$ of the device 100 depends on the distance R between the inlets 140 and the longitudinal axis 155 of the device 100. When the inlets 140 are located at a grater distance R from the axis of the device 100, the device 100 moves faster at the same depth. As a result, the speed of the device 100 can be manipulated by changing the distance R between the liquid inlets 140 and the longitudinal axis 155 of the device 100.

In one embodiment, the liquid inlets 140 are movable. Preferably, the inlets 140 are moved to change their distance from the housing 105 of the device 100. In the preferred embodiment, the movement of the inlets 140 is parallel to the edges 150 of fins 130 of the device 100. Since the device 100 finds equilibrium when the Riabouchinsky cavity 200 is centered on the inlets 140, the speed of the device 100 adjusts according to the change in the position of the inlets 140. If the inlets become closer to the housing 105, the device 100 eventually slows down to decrease the diameter of the Riabouchinsky cavity 200, so it continued being centered on the inlets 140 at their new position. If the inlets 140 are moved away from the housing 105, the device 100 eventually settles on a new higher speed to adjust the diameter of the Riabouchinsky cavity accordingly.

I claim:

1. A jet propulsion device for operating in an ambient liquid, comprising:

a housing having a nose having a tip; a tail; a longitudinal axis; and an outer surface;

at least one liquid inlet for allowing the ambient liquid to enter the device positioned a distance substantially R from the inlet to the longitudinal axis of the housing, and a distance substantially l from the tip of the nose along the longitudinal axis;

the distance R is greater than the radius of the outer surface of the housing at the distance substantially l; where R and l are non-zero;

at least one exhaust opening;

a reaction chamber; the reaction chamber is connected to the at least one liquid inlet by a liquid conduit; the reaction chamber is connected to the at least one exhaust opening; the reaction chamber is configured to vaporize at least a portion of the ambient liquid entering the reaction chamber from the liquid conduit to produce vapor, and to pass at least a portion of the vapor through the at least one exhaust opening.

2. The device of claim 1 further configured so that an equilibrium speed $\upsilon$ of the device is substantially equal to $$\upsilon=\sqrt{(D\cdot 2g/Q)}$$

where D is a depth of the device; and

Q is the cavitation number of the Riabouchinsky cavity of the device.

3. The device of claim 1 further comprising at least three fins protruding from the outer surface of the housing:

wherein the at least one of the liquid inlets is located in a leading edge of at least one of the fins.

4. The device of claim 3 wherein the fins are evenly spaced around the housing.

5. The device of claim 1 further configured so that the at least one exhaust opening is located closer to the tip of the nose than the at least one liquid inlet.

6. The device of claim 1 wherein the nose has a substantially ogival profile.

7. The device of claim 1 wherein the nose has a profile substantially similar to a Riabouchinsky cavity profile.

8. The device of claim 1 wherein the at least one exhaust opening is in the form of a nozzle.

9. The device of claim 1 wherein the at least one exhaust opening is in the form of a de Laval nozzle, directed towards the tail.

10. The device of claim 1 further comprising exhaust openings evenly spaced in a circle surrounding the housing.

11. The device of claim 1 wherein the portion of the vaporized liquid is about 50% by weight of the ambient liquid entering the reaction chamber.

12. The device of claim 1 further comprising an inlet moving mechanism configured to radially move the at least one inlet so that the distance substantially R from the inlet to the longitudinal axis of the device changes.

13. The device of claim 1 wherein the length of the device is substantially equal to or less than the length of the Riabouchinsky cavity.

14. The device of claim 1 wherein the ambient liquid is water.

15. The device of claim 1 wherein the ambient liquid is seawater.

16. A jet propulsion device for operating in an ambient liquid, comprising:

a housing having a nose having a tip; a tail; a longitudinal axis; and an outer surface;

at least one liquid inlet for allowing ambient liquid to enter the device positioned at a distance substantially R from the inlet to the longitudinal axis of the housing, and a distance substantially l from the tip of the nose along the longitudinal axis;

when the device is moving at a substantially constant speed the radius of the Riabouchinsky cavity at the distance substantially l is substantially equal to the distance substantially R;

at least one exhaust opening;

a reaction chamber; the reaction chamber is connected to the at least one liquid inlet by a liquid conduit; the reaction chamber is connected to the at least one exhaust opening; the reaction chamber is configured to vaporize at least a portion of the ambient liquid entering the reaction chamber from the liquid conduit to produce vapor, and to pass at least a portion of the vapor through the at least one exhaust opening.

17. A method for controlling the movement of a jet propulsion device in an ambient liquid comprising causing the ambient liquid to enter a reaction chamber of the device through at least one liquid inlet;

locating the inlet a desired distance substantially R from the longitudinal axis of the device and a desired distance substantially l from a tip of the nose of the device; where R and l are non-zero;

vaporizing at least a portion of the ambient liquid in the reaction chamber;

causing vapor to exit the device through at least one exhaust opening to move the device through the ambient liquid;

creating a Riabouchinsky cavity;

wherein the distance R is greater that the radius of an outer surface of a housing of the jet propulsion device at distance l maintaining a substantially desired constant speed of the device by locating the inlet at the desired distance R.

18. The method of claim 17 further controlling the movement of the device comprising increasing the device's depth thereby causing the radius of the Riabouchinsky cavity to decrease;

increasing the intake of the ambient liquid through the at least one inlet due to the inlet being fully submerged in the ambient liquid;

increasing the amount of the vapor produced by the reaction chamber;

causing the speed of the device to increase due to increase of the amount of the vapor exiting the device;

causing the radius of the Riabouchinsky cavity to increase due to the increase in the speed of the device;

causing the device to find an equilibrium speed where the radius of the Riabouchinsky cavity is substantially R.

19. The method of claim 17 further controlling the movement of the device comprising decreasing the device's depth thereby causing the radius of the Riabouchinsky cavity to increase;

decreasing the intake of the ambient liquid through the at least one inlet due to the inlet being submerged in the Riabouchinsky cavity;

decreasing the amount of the vapor produced by the reaction chamber;

causing the speed of the device to decrease due to decrease of the amount of the vapor exiting the device;

causing the radius of the Riabouchinsky cavity to decrease due to the decrease in the speed of the device;

causing the device to find an equilibrium speed where the radius of the Riabouchinsky cavity is substantially R.

20. The method of claim 17 further changing depth of the device comprising changing the distance R for the at least one inlet using an inlet moving mechanism:

changing the radius of the Riabouchinsky cavity due to the change in the distance R:

changing the intake of the ambient liquid due to the change of the Riabouchinsky cavity;

changing the amount of vapor produced by the reaction chamber due to the change in the amount of ambient liquid entering the reaction chamber;

changing the speed of the device due to the change in the amount of vapor exiting the device;

causing the device to find a new equilibrium speed where a new radius of the Riabouchinsky cavity is substantially the new distance from the at least one inlet to the longitudinal axis of the device.

* * * * *

UNITED STATES PATENT AND TRADEMARK OFFICE

CERTIFICATE OF CORRECTION

PATENT NO. : 8,092,265 B2
APPLICATION NO. : 12/473201
DATED : January 10, 2012
INVENTOR(S) : Calvin A. Gongwer It is certified that error appears in the above-identified patent and that said Letters Patent is hereby corrected as shown below:

Column 6,
Line 5, "allowing ambient liquid" should read -- allowing the ambient liquid --.

Signed and Sealed this
Thirteenth Day of March, 2012

David J. Kappos

David J. Kappos
*Director of the United States Patent and Trademark Office*